US008169326B2

(12) United States Patent
Niva et al.

(10) Patent No.: US 8,169,326 B2
(45) **Date of Patent: *May 1, 2012**

(54) PORTABLE ELECTRONIC DEVICE AND COMPUTER SOFTWARE PRODUCT

(75) Inventors: Arto Niva, Jaali (FI); Hannu Kinnunen, Oulu (FI); Tero Posio, Oulu (FI); Ilkka Heikkila, Oulu (FI)

(73) Assignee: Polar Electro Oy, Kemple (FI)

( * ) Notice: Subject to any disclaimer, the term of this patent is extended or adjusted under 35 U.S.C. 154(b) by 0 days.

This patent is subject to a terminal disclaimer.

(21) Appl. No.: 12/760,675

(22) Filed: Apr. 15, 2010

(65) Prior Publication Data

US 2010/0197403 A1 Aug. 5, 2010

Related U.S. Application Data

(63) Continuation of application No. 11/789,024, filed on Apr. 23, 2007, now Pat. No. 7,728,723.

(30) Foreign Application Priority Data

Apr. 24, 2006 (FI) ..... 20065259

(51) Int. Cl.
*G08B 23/00* (2006.01)

(52) U.S. Cl. ..... 340/573.1; 340/539.11; 340/539.24; 340/870.19; 463/36; 482/4; 482/6; 482/8

(58) Field of Classification Search ..... 340/539.11, 340/539.16, 539.24, 573.1, 870, 870.09, 340/870.16, 870.19; 463/36; 600/587, 595, 600/300; 702/160; 482/4, 6, 8, 1
See application file for complete search history.

(56) References Cited

U.S. PATENT DOCUMENTS

| | | | | |
|---|---|---|---|---|
| 4,443,008 | A | 4/1984 | Shimano | |
| 5,989,157 | A | 11/1999 | Walton | |
| 5,989,200 | A | 11/1999 | Yoshimura et al. | |
| 6,837,827 | B1 | 1/2005 | Lee et al. | |
| 2002/0019586 | A1 | 2/2002 | Teller et al. | |
| 2002/0118121 | A1 | 8/2002 | Lehrman et al. | |
| 2003/0017913 | A1 | 1/2003 | Stewart | |
| 2005/0118121 | A1 | 8/2005 | Hjelt et al. | |
| 2005/0197184 | A1* | 9/2005 | Ahlquist | 463/29 |
| 2006/0020174 | A1* | 1/2006 | Matsumura et al. | 600/300 |
| 2006/0052727 | A1 | 3/2006 | Palestrant | |
| 2006/0064277 | A1 | 3/2006 | Jung et al. | |

FOREIGN PATENT DOCUMENTS

| | | | |
|---|---|---|---|
| EP | 1618844 | A1 | 1/2006 |
| WO | WO03013354 | A1 | 2/2003 |

* cited by examiner

*Primary Examiner* — Jennifer Mehmood
*Assistant Examiner* — Hongmin Fan
(74) *Attorney, Agent, or Firm* — Hoffmann & Baron, LLP

(57) ABSTRACT

The invention relates to a portable electronic device and computer software product. The portable electronic device comprises a motion detector for generating motion data characterizing the local movement of the portable electronic device, a motion intensity determiner for determining a instantaneous motion intensity value of the user of the portable electronic device from the motion data, and an active time counter for determining an active time accumulation that sums up the time periods, during which the instantaneous motion intensity value meets predefined activity criteria.

21 Claims, 5 Drawing Sheets

PORTABLE ELECTRONIC DEVICE AND COMPUTER SOFTWARE PRODUCT

CROSS-REFERENCE TO RELATED APPLICATIONS

This application is a continuation of pending U.S. patent application Ser. No. 11/789,024 filed on Apr. 23, 2007, which claims priority to Finnish Patent Application Serial No. 20065259, filed on Apr. 24, 2006, which are incorporated herein by reference.

BACKGROUND OF THE INVENTION

1. Field of the Invention

The invention relates to a portable electronic device and a computer software product. The portable electronic device and computer software product implement a process for determining the intensity of a performance.

2. Description of the Related Art

Recommendations provided by international organizations and professionals exist on the suitable amount of daily exercise for boosting health. Examples of such organizations are AGSM (American College of Sports Medicine) and CDC (Centers for Disease Control).

When doing normal daily routines or an irregular and long-term performance, such as a physical exercise, it is, however, difficult for an ordinary person to estimate the intensity and duration of the performance and whether the recommended amount of exercise is reached. The performance may be interrupted for indefinable time periods or the intensity of the performance may decrease such that the person finds it difficult to estimate, whether the criteria set for the performance are met.

Thus, it is useful to examine techniques for reliably estimating the intensity of a performance.

SUMMARY OF THE INVENTION

It is an object of the invention to provide a portable electronic device and a computer software product in such a manner that the intensity of a performance may be estimated through measuring. A first aspect of the invention presents a portable electronic device that comprises a motion detector for generating motion data characterizing the local movement of the portable electronic device; a motion intensity determiner configured to determine a instantaneous motion intensity value for the user of the portable electronic device from the motion data; and an active time counter configured to determine an active time accumulation that sums up the time periods, during which the instantaneous motion intensity value meets predefined activity criteria.

A second aspect of the invention presents a computer software product that comprises encoded instructions for executing in a digital processor a computer process that is suitable for determining the intensity of a performance and comprises the following process steps: inputting motion data characterizing the local movement of a portable electronic device; determining a instantaneous motion intensity value of the user of the portable electronic device from the motion data; and determining an active time accumulation that sums up the time periods, during which the instantaneous motion intensity value meets predefined activity criteria.

Preferred embodiments of the invention are disclosed in the dependent claims.

The invention is based on determining an active time accumulation from instantaneous motion intensity data, and the active time accumulation sums up the time periods, during which the instantaneous motion intensity value meets predefined activity criteria.

The method and system of the invention provide several advantages. One advantage is that the invention provides an objective estimate on the time accumulation of the activity of the user.

BRIEF DESCRIPTION OF THE DRAWINGS

The invention will now be described in greater detail by means of preferred embodiments and with reference to the attached drawings, in which.

DETAILED DESCRIPTION OF THE PREFERRED EMBODIMENTS

Figure 1:
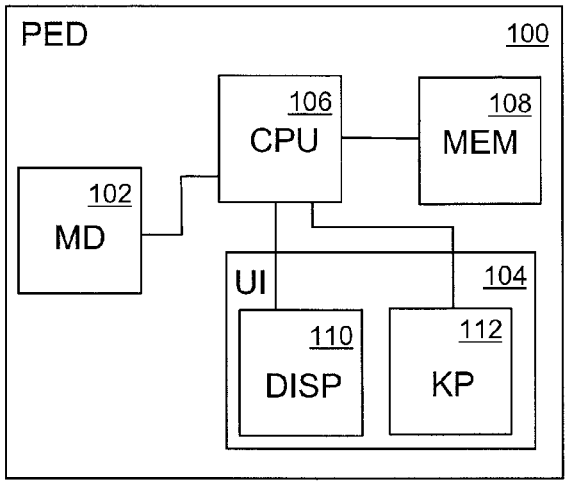
FIG. 1 shows a first example of the structure of the portable electronic device.

With reference to the example of FIG. 1, the portable electronic device (PED) 100 comprises a central processing unit (CPU) 106 and memory unit (MEM) 108. The central processing unit 106 comprises a digital processor and executes a computer process according to encoded instructions stored in the memory unit 108, the process being suitable for determining the intensity of a performance.

Figure 2:
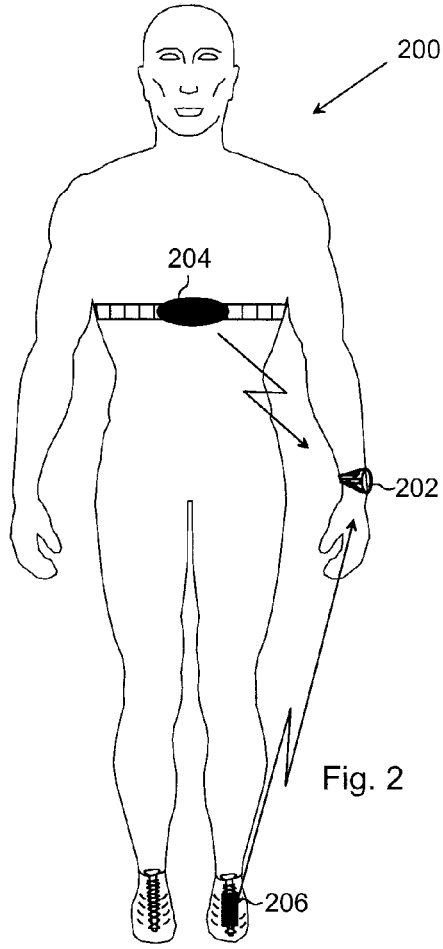
FIG. 2 shows a second example of the structure of the portable electronic device.

The portable electronic device 100 is a mobile phone or pedometer, for instance. In one embodiment, the portable electronic device 100 is a wrist device that may for instance be the wrist device 202 of a performance monitor shown in FIG. 2. A performance monitor may comprise not only the wrist device 202, but also one or more auxiliary devices 204, 206, such as a motion sensor 206 fastened to a limb of the user 200 of the portable electronic device and/or a pulse transmitter 204 indicating electric pulses induced by the heart. The auxiliary device 204, 206 may communicate over wire or wirelessly with the wrist device 202. In this context, the user 200 of the portable electronic device is referred to as the user 200.

In one embodiment, the portable electronic device 100 comprises a wrist device 202 and at least one auxiliary device 204, 206.

With reference to FIG. 1, the portable electronic device 100 also comprises a motion detector (MD) 102 that generates motion data characterizing the local movement of the portable electronic device.

In one embodiment, the motion detector 102 is in the wrist device 202.

In one embodiment, the motion detector 102 is in the auxiliary device 204, 206.

The local movement of the portable electronic device 100 is typically the movement of a limb or other body part of the user 200, with a motion component related to the step of the user 200 included therein. The amplitude of the local movement is typically in the range of the amplitude of the movement of the user's 200 limbs.

In one embodiment, the motion detector 102 comprises an acceleration sensor that measures the acceleration related to the movement of the user 200. The acceleration sensor transforms the acceleration caused by a movement or gravity into an electric signal.

In one embodiment, the acceleration sensor is based on piezo-resistor technology that uses a material whose resistance changes as the piezo resistor compresses as a result of the acceleration of the mass. When directing a constant current through the piezo resistor, the voltage over the piezo resistor changes according to the compression caused by the acceleration.

In one embodiment, the acceleration sensor is based on piezoelectric technology, in which a piezoelectric sensor generates a charge when the acceleration sensor is accelerated. In silicon-bridge technology, a silicon chip is etched in such a manner that a silicon mass remains on the silicon chip at the end of a silicon beam. When acceleration is directed to the silicon chip, the silicon mass directs the force to the silicon beam, whereby the resistance of the silicon beam changes.

The acceleration sensor may also be based on micromachined silicon technology that is based on the use of a differential capacitor. In addition, the acceleration sensor may be based on voice coil technology that is based on the same principle as a microphone. Examples of suitable motion detectors include Analog Devices ADXL105, Pewatron HW, and VTI Technologies SCA series.

The motion data generated by the acceleration sensor may be brought to the central processing unit 106 or memory unit 108. The motion data may for instance comprise acceleration data and/or motion pulse data related to the movements of the user 200.

The motion detector 102 may also be based on other technologies suitable for the purpose, such as a gyroscope integrated on a silicon chip or a micro-vibration switch placed in a surface-mounting component.

The motion detector 102 may comprise a pre-processing unit for processing primary motion data, such as acceleration data and/or vibration data. The processing may comprise transforming primary motion data into secondary motion data, for instance transforming acceleration data related to a user-generated movement into motion pulse data. The processing may also comprise filtering primary and/or secondary motion data.

The portable electronic device 100 may also comprise a user interface (UI) 104 that typically contains a display unit (DISP) 110 and display adapter. The display unit 110 may contain LCD (Liquid Crystal Display) components, for instance. The display unit 110 may display graphically and/or numerically the instantaneous motion intensity or active time accumulation, for instance, to the user 200.

The user interface 102 may also contain a keypad (KP) 112, with which the user 200 may input commands into the performance monitor 100.

Figure 3:
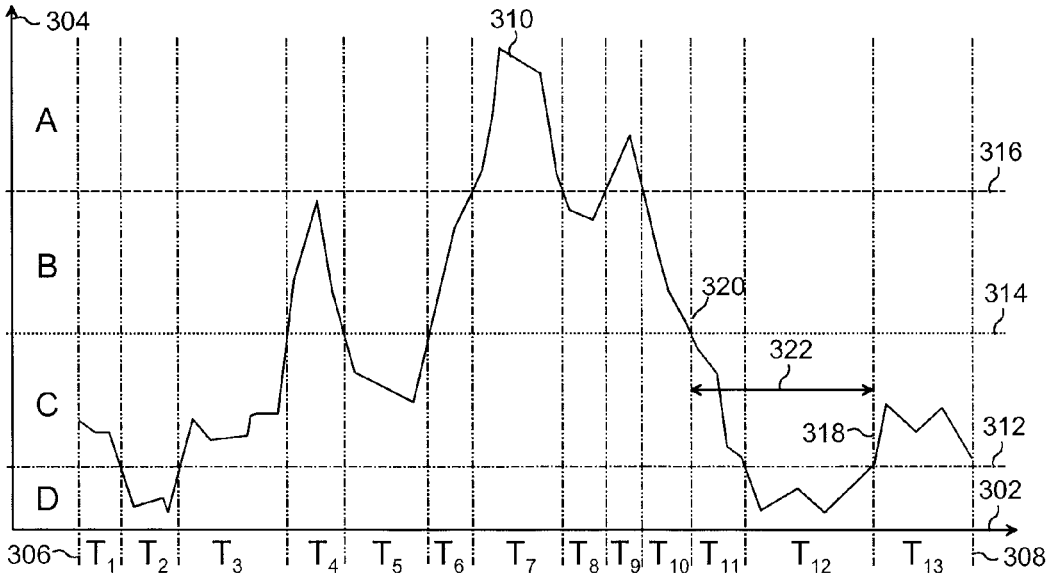
FIG. 3 shows an example of a motion intensity curve.

With reference to the example of FIG. 3, let us examine a motion intensity curve 310 that shows the time dependence of the instantaneous motion intensity value of the user 200. The horizontal axis shows time using a time unit, such as minute, and the vertical axis 304 shows the motion intensity value using a motion intensity unit, such as pulse/minute (p/min).

The motion intensity value characterizes the quantity of the user's 200 movement in a time unit. In one embodiment, the motion intensity value characterizes the number of motion pulses per minute or per some other suitable time unit.

An instantaneous motion intensity value is a motion intensity value calculated for a time instant. A instantaneous motion intensity value at a time instant may be determined for instance by calculating the motion pulses accumulated during a measuring period, such as minute, and dividing the number of motion pulses by the measuring period. The time instant associated with a determined instantaneous motion intensity value may for instance be the start time or end time of the measuring period, or a time instant in the middle of the measuring period.

An active time accumulation is an accumulating time accumulation that contains summed-up time periods, during which the instantaneous motion intensity value meets predefined activity criteria. A predefined activity criterion is for instance a predefined motion intensity level that defines the low limit of the instantaneous motion intensity value. An active time accumulation is a quantity that, when presented to the user 200, helps the user 200 to estimate the intensity of the performance.

In the example of FIG. 3, the predefined activity criterion is for instance motion intensity level 314 marked with a dotted line, in which case the time periods meeting the activity criteria are $T_4$, $T_6$, $T_7$, $T_8$, $T_9$, and $T_{10}$.

In one embodiment, the active time accumulation is calculated for a specified time period that in the example of the figure may be the period between the start time 306 and end time 308. The active time accumulation during the specified time period is then $T_4+T_6+T_7+T_8+T_9+T_{10}$, when the predefined activity criterion is motion intensity level 314. The time periods may be implemented in such a manner that the periods overlap each other. For instance, let us examine 60-second time periods at 10-second intervals. Instantaneous motion intensity values are then added to the 60-second time period at 10-second time intervals for the most recent 10 seconds, and at the same time, the motion intensity values for the oldest 10 seconds are deleted. This arrangement provides advantages for instance when a person has a 60-second active period that does not occur on the minute.

The start time 306 may be the turn of the day, or a time instant 24 hours before the current time. The end time 308 may be the turn of the day, without limiting the present solution to the present embodiment.

When active time determination is being done, the end time 308 may be the current time instant. The active time accumulation then indicates the active time accumulation from the start time 306 to the current time instant.

In one embodiment, the portable electronic device 100 determines an inactive time accumulation that contains the summed-up time periods, during which the instantaneous motion intensity value meets predefined inactivity criteria. A predefined inactivity criterion is for instance a predefined motion intensity level that defines the high limit of the instantaneous motion intensity value.

The inactive time accumulation may be presented to the user with the display unit 110.

In the example of FIG. 3, the predefined inactivity criterion is for instance motion intensity level 314 that is marked with a dotted line, in which case the time periods meeting the inactivity criteria are $T_1$, $T_2$, $T_3$, $T_5$, $T_{11}$, $T_{12}$, and $T_{13}$. The inactivity time accumulation for the time period between the start time 306 and end time 308 is thus $T_1+T_2+T_3+T_5+T_{11}+T_{12}+T_{13}$.

In one embodiment, the portable electronic device 100 distributes the instantaneous motion intensity values into at least two intensity classes on the basis of predefined intensity class limits, and the active time accumulation is determined by intensity class. The example of FIG. 3 shows intensity classes A, B, and C. Intensity class C comprises the motion intensity values that are between motion intensity levels 312 and 314, intensity class B comprises the motion intensity values that are between motion intensity levels 314 and 316, and intensity class A comprises the motion intensity values that are above motion intensity level 316.

Intensity class D comprises motion intensity values that are below motion intensity level 312, and it may also be defined as an inactivity class.

Motion intensity levels 312, 314, and 316 may be 2 p/min, 30 p/min, and 50 p/min, respectively. Intensity class D may then be defined as an idle, intensity class C as an extremely light, intensity class B as a light, and intensity class A as a moderate to high intensity class.

Activities that require that the user move belong to intensity classes A and B. They are suitable for providing performance instructions. Intensity class A may be applied to general exercises that require at least 30 minutes of moderate to high intensity class exercise daily, several days a week. Intensity classes C and D may also be referred to as inactivity classes.

In one embodiment, the criteria of intensity classes A and B depend on the height of the person.

In the present example, the class-specific active time accumulations are as follows:

A intensity class: $T_7+T_9$

B intensity class: $T_4+T_6+T_8+T_{10}$.

In this case, the inactivity accumulation is $T_1+T_2+T_3+T_5+T_{11}+T_{12}+T_{13}$.

In an embodiment of the invention, an intensity class is set according to a predefined physiological benefit effect that is obtained by the user's activity exceeding the predefined activity criterion.

In an embodiment of the invention, the predefined physiological benefit effect is a health benefit that sets an activity level, at which the user is expected to perform an activity in order to maintain or increase the current health. In this case, the activity criterion may be equivalent to 30 to 65 percent of the maximum oxygen uptake ($VO_{2max}$) during an exercise. The maximum oxygen uptake may also be referred to as the maximum aerobic fitness level.

The health benefit may typically be obtained with continuous low intensity motion, such as walking, cleaning or gardening.

In an embodiment of the invention, the predefined physiological benefit effect is a fitness benefit that sets an activity level, at which the user is expected to perform an activity in order to maintain or increase the current fitness level. In this case, the activity criterion may be equivalent to more than 65 percent of the maximum oxygen uptake ($VO_{2max}$) during an exercise.

The fitness benefit may typically be obtained with continuous intermediate or high intensity training, such as brisk walking and jogging.

In an embodiment of the invention, the predefined activity criterion is calculated from user parameters, such as age, gender, weight, length, and/or user-specific health indicators. A user-specific health indicator may indicate blood pressure level or a disease, such as diabetes. The user parameters may be input into the portable electronic device through the user interface 104. The central processing unit 106 may include encoded instructions for calculating the predefined activity criterion from the user parameters.

In an embodiment of the invention, the user parameters include heart rate variables obtained from heart rate measurement carried out by the pulse transmitter 204. The predefined activity criterion may then be proportional to a heart rate variable, such as resting heart rate of heart rate variation. The central processing unit 106 may include encoded instructions for calculating the predefined activity criterion from the heart rate variables.

In an embodiment of the invention, the active time counter 406 starts determining the active time accumulation after a time threshold that is proportional to a user parameter. A user having a high performance expectation indicated by the user parameters may have a longer time threshold than a person having a lower performance expectation. The time threshold defines a time of continuous activity which should precede the actual active time accumulation determination.

Figure 4A:
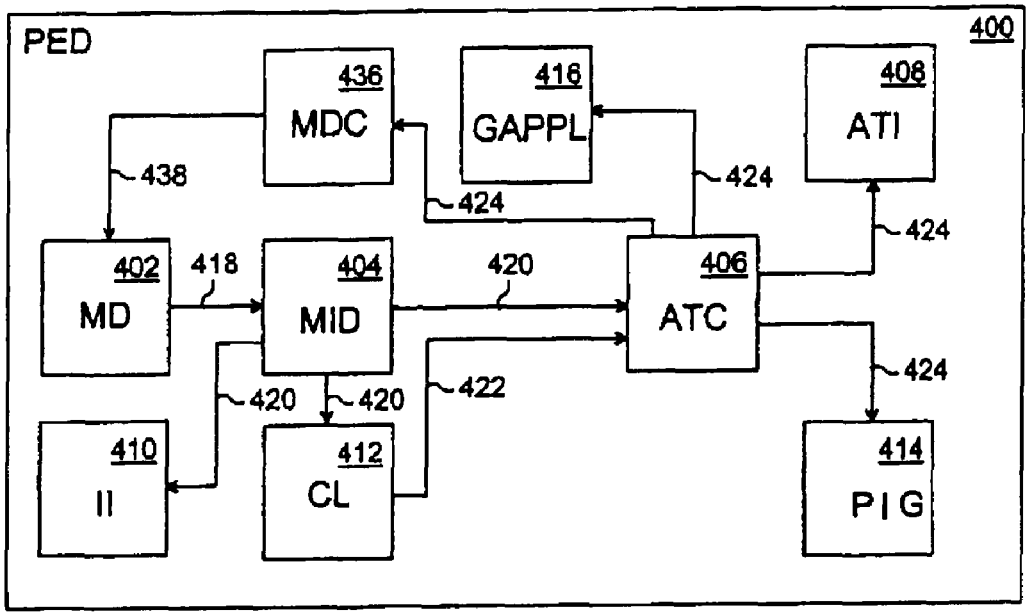
FIG. 4A shows a third example the structure of the portable electronic device.

With reference to the example of FIG. 4A, let us examine a portable electronic device (PED) 400 that comprises a motion detector (MD) 402, motion intensity determiner (MID) 404, and an active time counter (ATC) 406.

The motion detector 402 generates motion data 418 characterizing the local movement of the portable electronic device 400 and inputs it into the motion intensity determiner 404.

The motion intensity determiner 404 determines instantaneous motion intensity values 420 from the motion data 418.

In one embodiment, the motion intensity determiner 404 filters motion data 422 on the basis of predefined time properties. The motion intensity determiner 404 may accept motion pulses meeting predefined criteria and use the accepted motion pulses to determine the motion intensity values.

In one embodiment, the motion intensity determiner 404 determines a motion intensity value from motion pulses, the interval between which is within predefined limits. The determination of the motion intensity values is then focused on motion frequencies that are typical of the human body and typically 1 to 2 pulses per second. The filtration may be implemented by rejecting consecutive motion pulses whose time interval is below a predefined low limit or above a predefined high limit.

The predefined high and low limits may depend on the location of the motion detector 402 on the user's 200 body. In the case of attachment to an upper limb, the predefined low limit may be 0.4 seconds, for example. The predefined high limit may be 2.0 seconds, for example.

The motion intensity determiner 404 may be implemented by a computer process execute in the central processing unit 106, the computer process being encoded into encoded instructions stored in the memory unit 108.

In one embodiment, the motion intensity determiner 404 inputs instantaneous motion intensity values 420 into the active time counter 406. The motion intensity determiner 404 may also input into the active time counter the time instant associated with each instantaneous motion intensity value. The active time counter 406 compares the motion intensity values with a predefined motion intensity level 314 and calculates the active time accumulation and possibly also inactive time accumulation on the basis of the comparison. The inactive time accumulation information may be included in the active time accumulation information 424.

In one embodiment, the portable electronic device 400 comprises a classifier (CL) 412 that receives the motion intensity values 420 from the motion intensity determiner 404 and performs comparison between the motion intensity values 420 and motion intensity levels 312, 314, 316. Using the comparison, the classifier 412 divides the instantaneous motion intensity values into intensity classes.

The classifier 412 inputs the classified motion intensity values 422 into the active time counter 406 that calculates class-specific active time accumulations.

The active time counter 406 may be implemented by a computer process execute in the central processing unit 106, the computer process being encoded into encoded instructions stored in the memory unit 108.

The classifier 412 may be implemented by a computer process execute in the central processing unit 106, the computer process being encoded into encoded instructions stored in the memory unit 108.

The active time accumulation may be presented to the user 200 with the display unit 110.

In one embodiment, the portable electronic device 400 comprises an active time indicator (ATI) 408 for indicating the active time accumulation time instant preceding the time period between the start time 306 and end time 308 to the user. The active time accumulations of earlier, such as day-specific, time periods may be stored into the memory unit 108 and shown graphically or numerically by means of the display unit 110 to the user 200. The user 200 may then follow the performance history and for instance compare the active time accumulation of the ongoing time period with the earlier values.

In one embodiment, the portable electronic device 400 comprises an intensity indicator (II) 410 for indicating the latest time instant of the motion intensity value meeting the activity criteria to the user 200. With reference to FIG. 3, let us assume that the current time instant is instant 318, and the activity criterion is determined from motion intensity level 314. The latest time instant of the motion intensity value meeting the activity criteria with respect to time instant 318 is time instant 320. The central processing unit 106 may input for storage into the memory unit 108 the latest time instant of the motion intensity value meeting the activity criteria. The display unit 110 may point the memory space of the memory unit 108 in such a manner that the contents of the memory are displayed in the display unit 108. By detecting the latest time instant of the motion intensity value meeting the activity criteria, the user 200 may determine the duration of the ongoing inactive time 322, for instance. The display unit may for instance display the text "inactive since T1:T2", wherein T1:T2 is the time instant when the activity criteria was last met.

With further reference to FIG. 4A, in one embodiment, the portable electronic device 400 comprises a performance instruction generator (PIG) 414 for generating a performance instruction on the basis of the active time accumulation.

The active time counter 406 inputs the active time accumulation data 424 into the performance instruction generator 414 that may compare the active time accumulation with reference values. The reference values may form ranges of variation that are associated with the performance instructions. The performance instruction may contain the following instructions: REST, LIGHT EXERCISE, and MODERATE TO HIGH EXERCISE. For instance, if the accumulation of the present day or the previous 24 hours in intensity classes A and B is less than 30 minutes, the user may be instructed to do light or moderate to heavy exercise. If the accumulation of intensity class A is less than 30 minutes for the previous three days, or the previous 72 hours, the performance instruction given may be moderate to high exercise.

In one embodiment, the intensity classification may be defined by exercise type. In addition to the above mentioned intensity classes, an E intensity class may be used, which defines the limits between walk and run.

The performance instruction may also be determined by several day-specific activity time accumulations.

The performance instruction generator 414 may be implemented by means of a computer process execute in the central processing unit 106, the computer process being encoded into encoded instruction stored in the memory unit 108.

In one embodiment, the portable electronic device 400 comprises at least one game application (GAPPL) 416 whose operation depends on at least one parameter proportional to the active time accumulation. A parameter proportional to the active time accumulation may be a control parameter that adjusts the operating time of the game application 416, 432. A high active time accumulation then may enable a longer use of the game application than a low active time accumulation would.

In one embodiment, the game application comprises an electronic figure, such as a pet, whose condition is dependent on the control parameter. With a high active time accumulation, the electronic figure may indicate satisfaction. With a low active time accumulation, the electronic figure may indicate dissatisfaction or switch to inactive.

The game application 416 may be implemented by a computer process execute in the central processing unit 106, the computer process being encoded into encoded instructions stored in the memory unit 108. In addition, the game application 416 may be connected to the user interface 104, with which the user 200 may use the game application 416.

In one embodiment, the portable electronic device 400 comprises a motion detector controller 436 connected to a motion detector 402 and an active time counter 406. The motion detector controller 436 receives inactive time accumulation information with active time accumulation information 424 and compares the inactive time accumulation with a predefined threshold value. If the inactive time accumulation exceeds the predefined threshold value, the motion detector controller 436 switches with a mode change command 438 the motion detector 402 into a measuring mode, in which motion data is generated discontinuously at predefined time intervals.

Discontinuous measuring achieves power saving in the motion detector 402.

The predefined threshold value is for instance 15 minutes, whereby after a 15-minute inactive time accumulation, the motion detector 402 is switched to a discontinuous measuring mode. In the discontinuous measuring mode, the motion detector 402 may be switched on at 5-minute intervals for 30 seconds, for instance. If the motion detector 402 detects activity, the motion detector controller 436 may switch the motion detector 402 into a continuous measuring mode. If the motion detector 402 does not detect activity, the discontinuous measuring mode may be continued. The above 15-minute, 5-minute and 30-second time values are examples, and the present solution is not restricted to them.

Figure 4B:
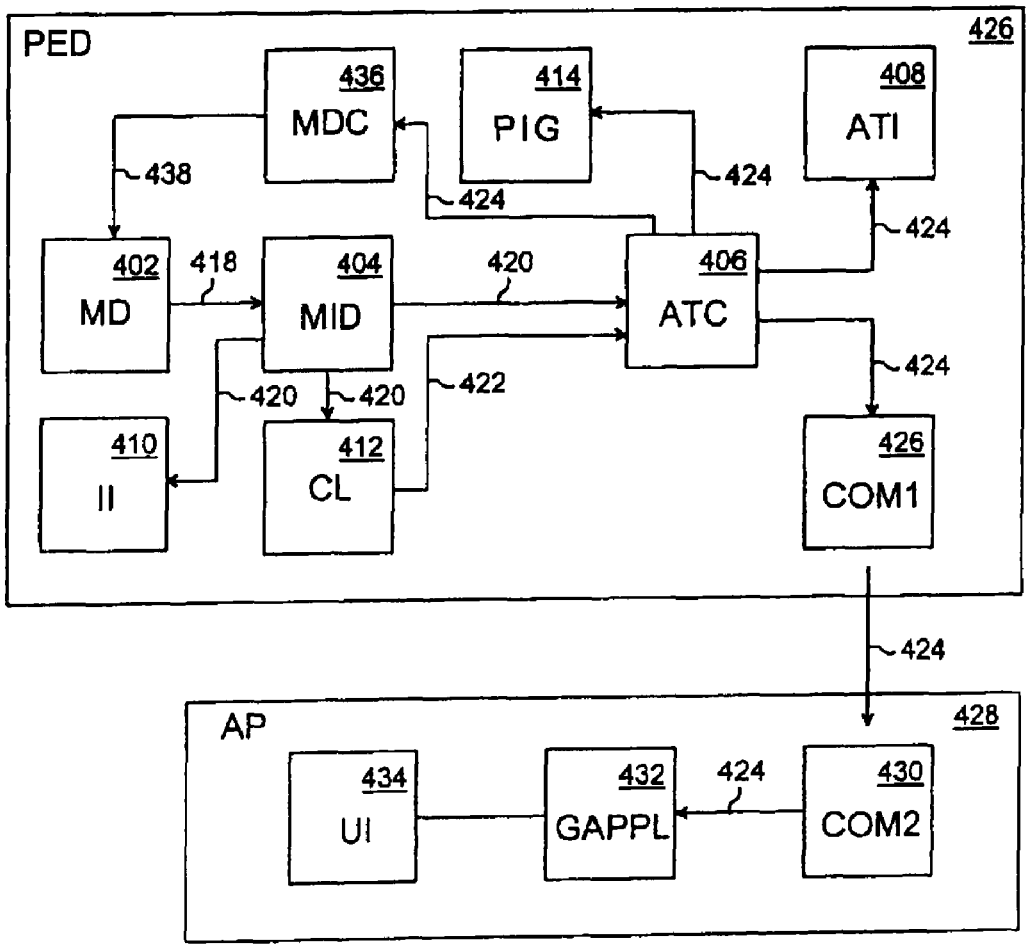
FIG. 4B shows an example of a system consisting of a portable electronic device and application platform.

With reference to FIG. 4B, the portable electronic device 400 may in one embodiment comprise a communication unit (COM1) 426 that connects the portable electronic device 400 to an application platform (AP) 428. The application platform 428 comprises an application platform communication unit (COM2) 430 that receives active time accumulation information 424 from the communication unit 426. The application platform communication unit 430 transmits the active time accumulation information 424 to an application platform game application 432. The application platform game application 432 may be controlled and/or monitored through a user interface 434. The operation of the game application 434 depends on at least one parameter proportional to the active time accumulation.

The communication unit 426 and application platform communication unit 430 may be connected to each other wirelessly or over wire.

The application platform 428 may be a PC (personal computer), portable computer (laptop), PDA (personal digital assistant), fixed or portable game console, mobile phone, or any other electronic device that comprises sufficient processing and memory capacity for executing the game application 432 and a user interface for using the game application 432.

Controlling the game application 416, 432 with a parameter proportional to the active time accumulation makes it possible to motivate children and young people to exercise. It is known that game applications have an addictive effect on children and young people and a passivating effect on the sports activities of children and young people. The active time accumulation may directly affect the operating time of the game application 416, 432, points distributed in the game application 416, 432, performance of the electronic figure, quantity of commodities used in the game application 416, 432, such as virtual money, power and/or number of virtual weapons, or other features pursued in the game application 416, 432. The user of the game application 416, 432 then benefits from high active time accumulation in the use of the game application 416, 432 and is motivated to exercise so as to achieve an as high active time accumulation as possible.

With reference to FIGS. 5, 6, 7, and 8, let us examine the computer processes of some embodiments shown by means of process steps. The process steps may also be interpreted as the method steps of the method.

Figure 5:
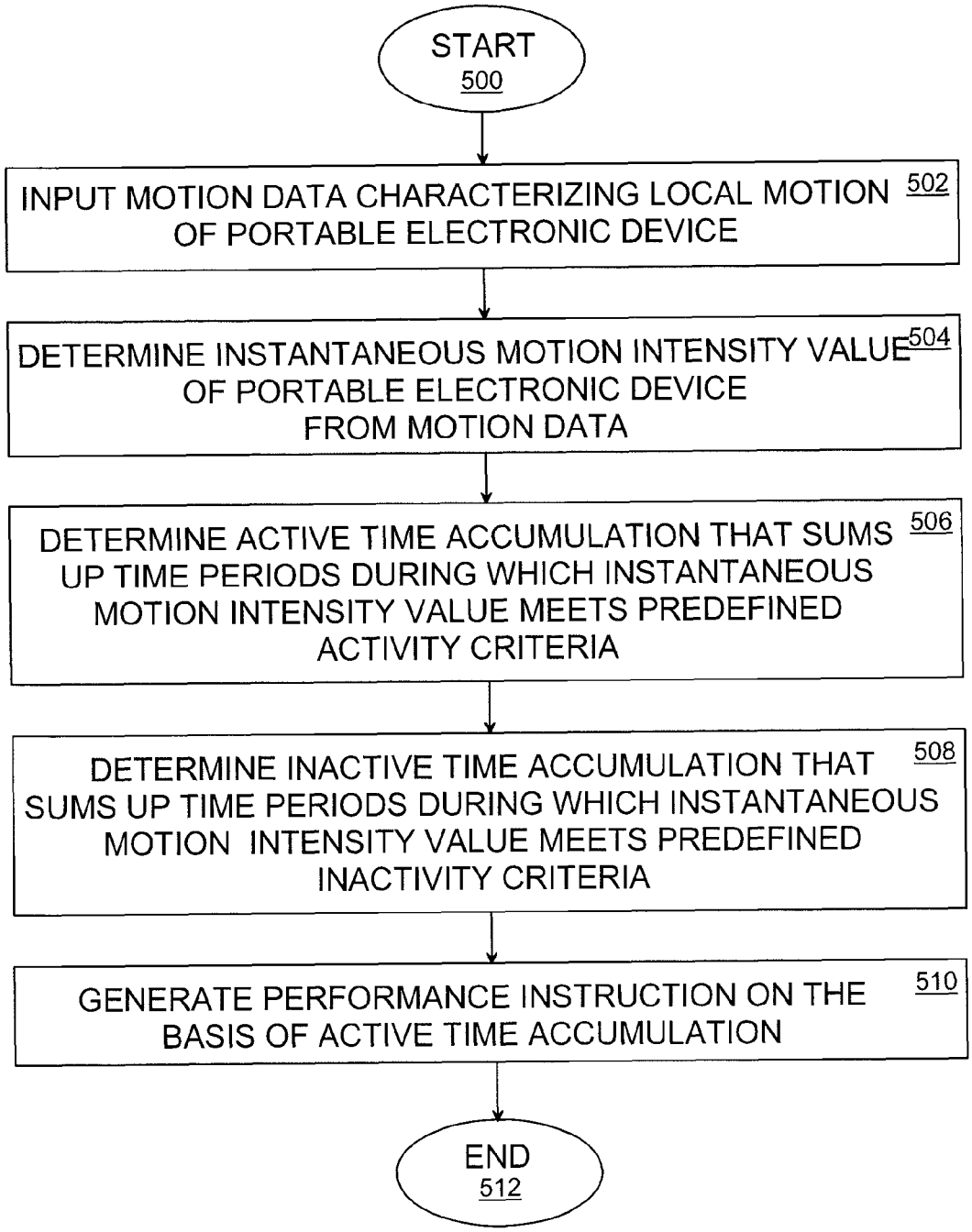
FIG. 5 shows a first example of a method of an embodiment of the invention.

The computer process starts in step 500 of FIG. 5.

In step 502, motion data characterizing the local movement of the portable electronic device is inputted.

In step 504, a instantaneous motion intensity value of the user of the portable electronic device is determined from the motion data.

In step 506, an active time accumulation is determined, which contains summed up time periods, during which the instantaneous motion intensity value meets predefined activity criteria.

In one embodiment, in step 508, an inactive time accumulation is determined, which contains summed up time periods, during which the instantaneous motion intensity value meets predefined inactivity criteria.

In one embodiment, in step 510, a performance instruction is generated on the basis of the active time accumulation.

The computer process ends in step 512.

Figure 6:
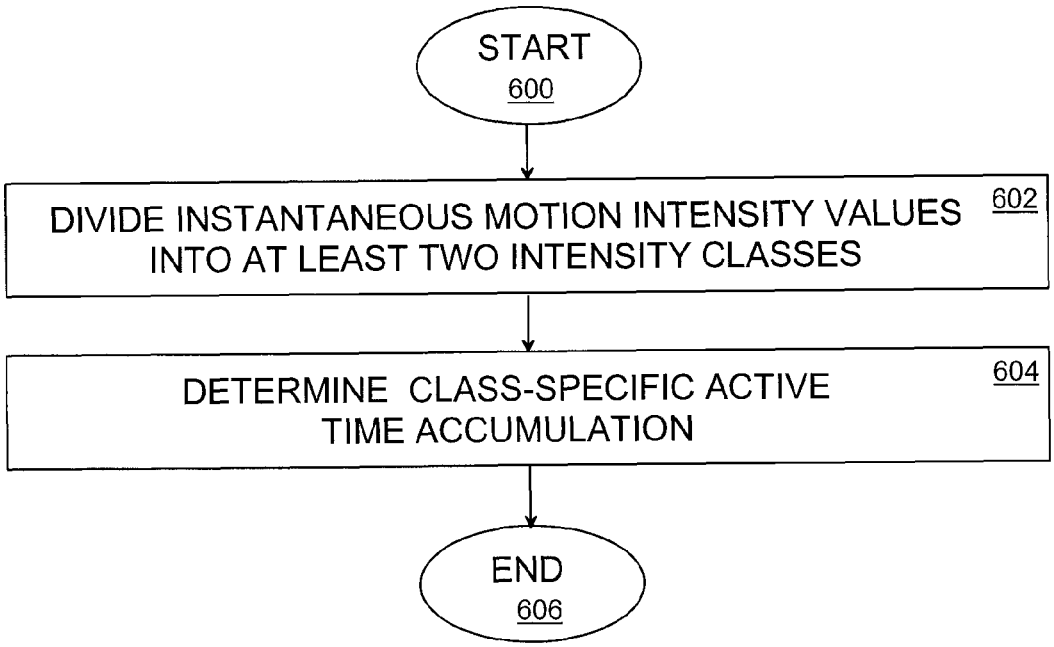
FIG. 6 shows a second example of a method of an embodiment of the invention.

With reference to FIG. 6, the computer process starts in step 600.

In step 602, instantaneous motion intensity values are divided into at least two intensity classes based on predefined intensity class limits.

In step 604, a class-specific active time accumulation is determined

The computer process ends in step 606.

Figure 7:
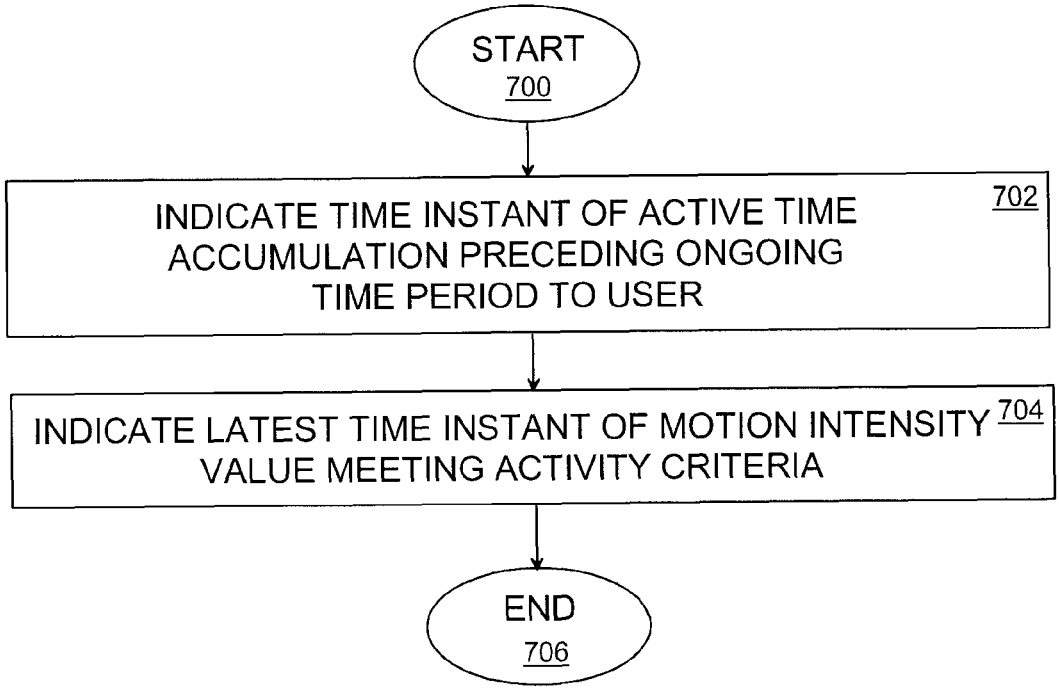
FIG. 7 shows a third example of a method of an embodiment of the invention.

With reference to FIG. 7, the computer process starts in step 700.

In step 702, the time instant of the active time accumulation preceding the ongoing time period is communicated to the user.

In step 704, the latest time instant of the motion intensity value meeting the activity criteria is communicated to the user.

The computer process ends in step 706.

Figure 8:
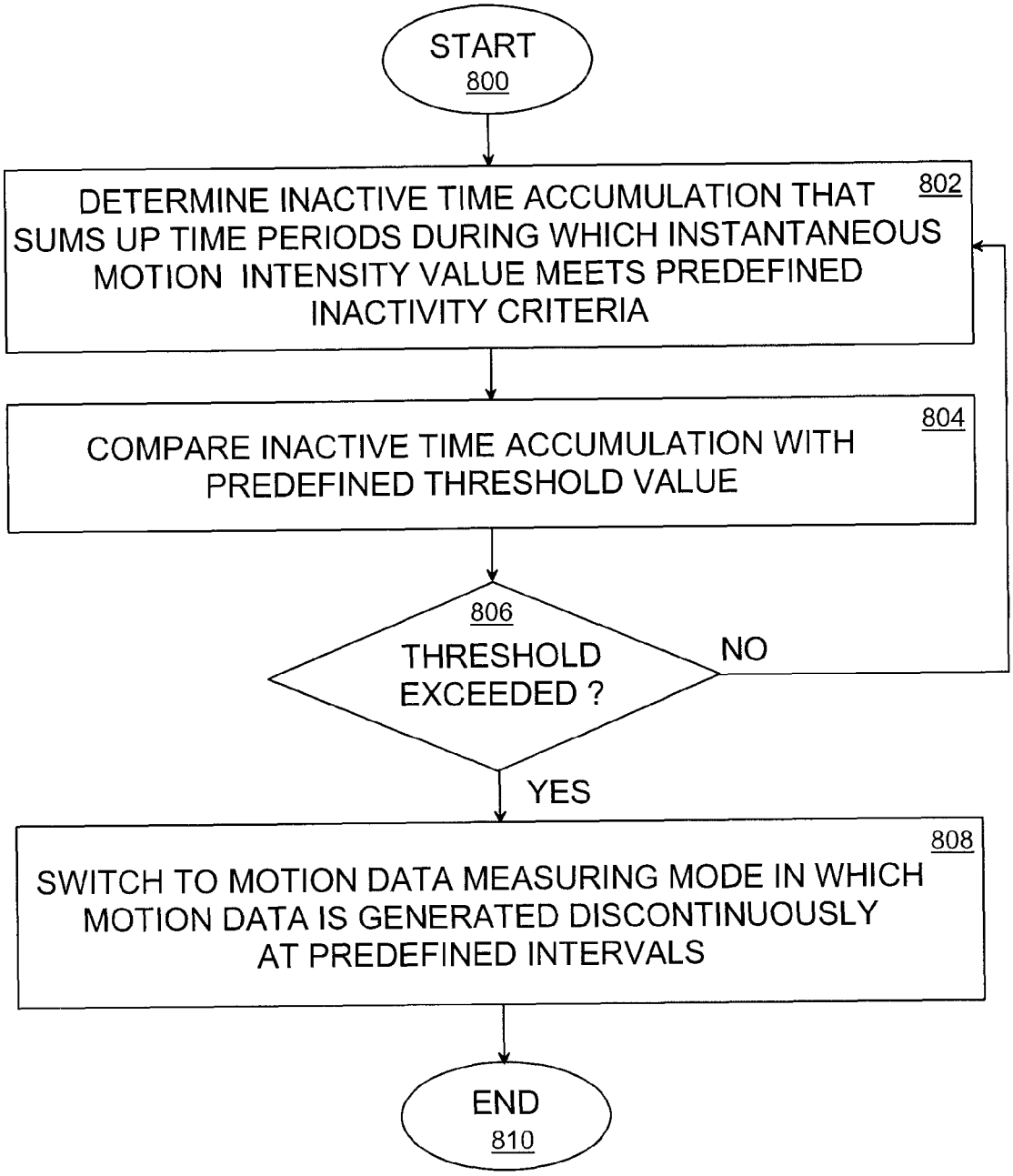
FIG. 8 shows another example of a method of an embodiment of the invention.

With reference to FIG. 8, the method starts in step 800.

In step 802, an inactive time accumulation is determined, which contains summed up time periods, during which the instantaneous motion intensity value meets predefined inactivity criteria.

In step 804, the inactivity time accumulation is compared with a predefined threshold value.

In step 806, a decision is made on whether the threshold value is exceeded.

If the threshold value is exceeded, in step 808, a measuring mode is started, which generates motion data discontinuously at predefined time intervals.

The method ends in step 810.

The computer process shown in FIGS. 5, 6, 7, and 8 may be included into a computer software product as encoded instructions that may be execute in the central processing unit 106 of the portable electronic device 100. The encoded instructions may be stored in the memory unit 108 of the portable electronic device 100.

In one embodiment, the computer software product comprises encoded instructions for executing a game application 416, 432. The game application 416, 432 may be executed in the central processing unit 106 of the portable electronic device 100 and/or the central processing unit of the application platform 428.

The encoded instructions may be transferred by means of a distribution medium. The distribution medium is an electronic, magnetic, or optic distribution medium, for instance. The distribution medium may be a physical distribution medium, such as a memory unit or optic disk, or a telecommunications signal.

Even though the invention is described above with reference to the example according to the drawings, it is clear that the invention is not limited thereto, but may be modified in many ways within the scope of the attached claims.

What is claimed is:

1. A method comprising:

receiving active time accumulation information over a communication interface, wherein the active time accumulation information represents a sum of time periods during which an instantaneous motion intensity value determined from motion data meets predefined activity criteria, wherein the motion data represents local movement of a portable electronic device;

executing a game application with encoded instructions;

transferring the active time accumulation information to the game application; and controlling the game application with a parameter proportional to the active time accumulation information.

2. The method of claim 1, wherein controlling the game application further comprises affecting operation time of the game application using the parameter proportional to the active time accumulation information.

3. The method of claim 1, wherein controlling the game application further comprises affecting points distributed in the game application using the parameter proportional to the active time accumulation information.

4. The method of claim 1, wherein controlling the game application further comprises affecting performance of electronic figures in the game application using the parameter proportional to the active time accumulation information.

5. The method of claim 1, wherein controlling the game application further comprises affecting quantity of commodities used in the game application using the parameter proportional to the active time accumulation information.

6. The method of claim 1, further comprising receiving the parameter proportional to the active time accumulation information from a portable electronic device.

7. The method of claim 1, further comprising monitoring the game application through a user interface.

8. The method of claim 1, wherein the method is executed in an application platform selected from a list comprising: personal computer, portable computer, personal digital assistant, fixed or portable game console, and mobile phone.

9. An electronic device, comprising:

a communication unit configured to receive active time accumulation information, wherein the active time accumulation information represents a sum of time periods during which an instantaneous motion intensity value determined from motion data meets predefined activity criteria, wherein the motion data represents local movement of a portable electronic device; and a processing unit configured to execute a game application, wherein the communication unit is further configured to transmit the active time accumulation information to the game application, wherein the game application is controllable with a parameter proportional to the active time accumulation information.

10. The electronic device of claim 9, wherein operation time of the game application is affected using the parameter proportional to the active time accumulation information.

11. The electronic device of claim 9, wherein points distributed in the game application are affected using the parameter proportional to the active time accumulation information.

12. The electronic device of claim 9, wherein performance of electronic figures in the game application is affected using the parameter proportional to the active time accumulation information.

13. The electronic device of claim 9, wherein quantity of commodities used in the game application is affected using the parameter proportional to the active time accumulation information.

14. The electronic device of claim 9, further comprising an active time communication unit configured to receive the parameter proportional to the active time accumulation information from a portable electronic device and to transfer the parameter to the game application.

15. A computer-readable medium comprising instructions encoded thereon that, when executed by a processing device, cause the processing device to:

receive active time accumulation information over a communication interface, wherein the active time accumulation information represents a sum of time periods during which an instantaneous motion intensity value determined from motion data meets predefined activity criteria, wherein the motion data represents local movement of a portable electronic device;

execute a game application with encoded instructions;

transfer the active time accumulation information to the game application; and control the game application using a parameter proportional to the active time accumulation information.

16. The computer-readable medium of claim 15 comprising instructions encoded thereon that, when executed by the processing device, cause the processing device to control operation time of the game application using the parameter proportional to the active time accumulation information.

17. The computer-readable medium of claim 15 comprising instructions encoded thereon that, when executed by the processing device, cause the processing device to control points distributed in the game application using the parameter proportional to the active time accumulation information.

18. The computer-readable medium of claim 15 comprising instructions encoded thereon that, when executed by the processing device, cause the processing device to control performance of electronic figures in the game application using the parameter proportional to the active time accumulation information.

19. The computer-readable medium of claim 15 comprising instructions encoded thereon that, when executed by the processing device, cause the processing device to control quantity of commodities used in the game application using the parameter proportional to the active time accumulation information.

20. The computer-readable medium of claim 15 comprising instructions encoded thereon that, when executed by the processing device, cause the processing device to receive active time accumulation from a portable electronic device.

21. The computer-readable medium of claim 15 comprising instructions encoded thereon that, when executed by the processing device, cause the processing device to monitor the game application through a user interface.

* * * * *